US006206761B1

(12) United States Patent
Bernhard

(10) Patent No.: US 6,206,761 B1
(45) Date of Patent: Mar. 27, 2001

(54) BEDKNIFE GRINDING DEVICE

(76) Inventor: Stephen Geoffrey Bernhard, 2 Church Walk, Rugby, Warwickshire, CV21 3AZ (GB)

( * ) Notice: Subject to any disclaimer, the term of this patent is extended or adjusted under 35 U.S.C. 154(b) by 0 days.

(21) Appl. No.: 09/245,469

(22) Filed: Feb. 5, 1999

(30) Foreign Application Priority Data

Feb. 6, 1998 (GB) ..... 9802525

(51) Int. Cl.[7] ..... B24B 1/00
(52) U.S. Cl. ..... 451/45; 451/349
(58) Field of Search ..... 451/45, 187, 193, 451/234, 293, 367, 369, 371, 349, 344; 29/428, 559

(56) References Cited

U.S. PATENT DOCUMENTS 5,685,768 11/1997 Bernhard et al. .
5,725,415 3/1998 Bernhard .
5,893,792 * 4/1999 Scott ..... 451/45

* cited by examiner

*Primary Examiner*—Derris H. Banks
(74) *Attorney, Agent, or Firm*—Troutman Sanders LLP; Harold L. Marquis; Ryan A. Schneider

(57) ABSTRACT

A device for grinding the bedknife 6 of a lawnmower comprising a mounting bar 4, electromagnets 2 which are mounted flush with the top face of mounting bar, and end brackets 8. In use, the bedknife is placed on mounting bar and is held in place by electromagnets while end brackets are positioned relative to the bedknife and the bedknife secured to them. When a grindstone motor (not shown) is started, the electromagnets are automatically de-energized. After grinding, the grindstone motor is stopped and electromagnets are re-energized to hold a bedknife in place while the end brackets are detached. The electromagnets are then manually de-energized so that the bedknife can be removed from the device.

15 Claims, 2 Drawing Sheets

BEDKNIFE GRINDING DEVICE

TECHNICAL FIELD

This invention relates to a device for grinding the bedknife of a lawnmower, in particular lawn or grass mowers of the type having a cylindrical cutting unit comprising blades in part helical form. The invention also provides a method for grinding the bedknife of a lawnmower.

Cylindrical or reel mowers comprise one or more cylinders or reels bearing a plurality of part helical blades mounted for rotation about a horizontal axis transverse to the direction of motion of the mower. Each cylinder or reel cuts the grass in cooperation with an elongate bottom blade, commonly referred to as a bedknife, which is disposed in alignment with the reel and positioned for the grass to be positioned accurately allowing the helical blade to cut the grass in a transverse scything motion. The front face of the bedknife becomes worn during grass cutting and is required to be sharpened periodically by grinding.

The term lawnmower is used to encompass all mowers employing this blade configuration, whether they are tractor mounted, towed, or are walking mowers.

BACKGROUND ART

It is known to use magnets to secure the bedknife to the grinding device. However, the magnets may distort the bedknife during the grinding process leading to an imperfect cutting edge.

GENERAL DISCUSSION OF INVENTION

The present invention seeks to overcome or at least mitigate the problems of the prior art.

One aspect of the invention provides a device for grinding the bedknife of a lawnmower, which device comprises support means to support the bedknife during grinding, at least one electromagnet energized to hold the bedknife in a pre-selected position relative to the support means, grinding means to grind the bedknife and control means to automatically de-energize the or each electromaget upon commencement of grinding. Preferably, the or each electromagnet is energized by means of a manual switch.

According to another optional feature of this aspect of the invention, securing means is provided by end mounted brackets which secure the bedknife relative the support means. Preferably, one bracket is positioned adjacent each axial end of the bedknife. Even more preferably, at least one bracket is slidably fixed to secure the bedknife to the mounting bar.

According to another optional feature of this aspect of the invention a mounting bar may provide support along the entire length of the bedknife.

According to another optional feature of this aspect of the invention the electromagnets may be mounted flush with the top face of the mounting bar.

A second aspect of the invention provides a method for grinding the bedknife of a lawnmower, comprising placing the bedknife of the lawnmower on a mounting bar, manually energising at least one electromagnet, securing the bedknife to at least one mounting bracket, commencing the grinding of the bedknife at which time the or each electromagnet is automatically de-energized, ceasing grinding the bedknife at which time the or each electromaget is automatically energized, freeing the bedknife from the or each mounting bracket, manually de-energizing the or each electromagnet to permit the removal of the bedknife.

BRIEF DESCRIPTION OF DRAWINGS

An embodiment of the invention will now be described by way of example with reference to the accompanying drawings, in which.

EXEMPLARY MODE FOR CARRYING OUT THE INVENTION

Figure 1:
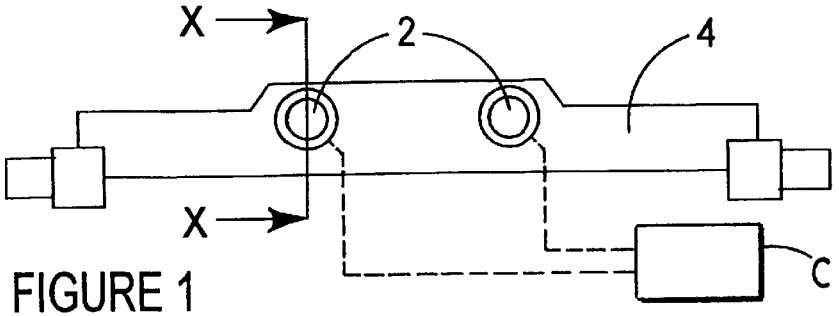
FIG. 1 is a plan view of a support means pivotal about a horizontal axis according to a first aspect of the invention.
Figure 2:
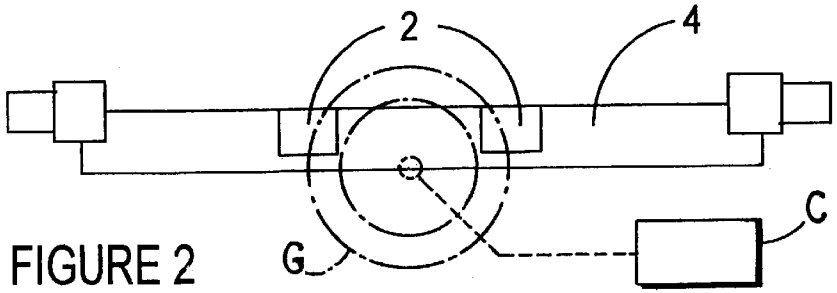
FIG. 2 is a front elevational view of the support means shown in FIG. 1.
Figure 3:
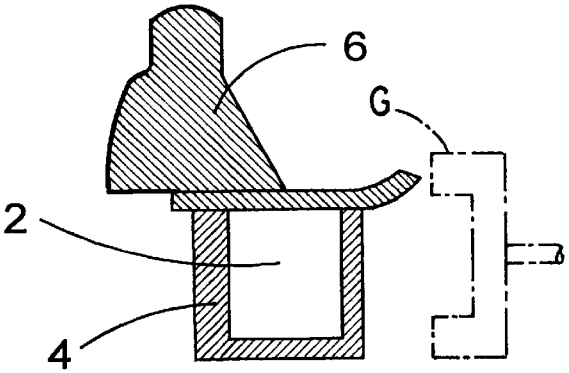
FIG. 3 is a cross ectional of the support means taken on the line X—X in FIG. 1.

Referring to the drawings, the device comprises support means 4 to support a bedknife 6 during grinding, at least one electromagnet 2 energized to hold the bedknife 6 in a pre-selected position relative to the support means 4, grinding means G to grind the bedknife 6 and control means C to automatically de-energize the or each electromagnet 2 upon commencement of grinding.

The electromagnets 2 are mounted within the bedknife 6 supporting means, such as a mounting bar 4, with the top faces of the magnets 2 mounted flush with the top face of the mounting bar. The top face of the mounting bar 4 is planar, thus providing a rest support along the entire length of the bedknife (bottom blade) 6 of a lawnmower.

Figure 4:
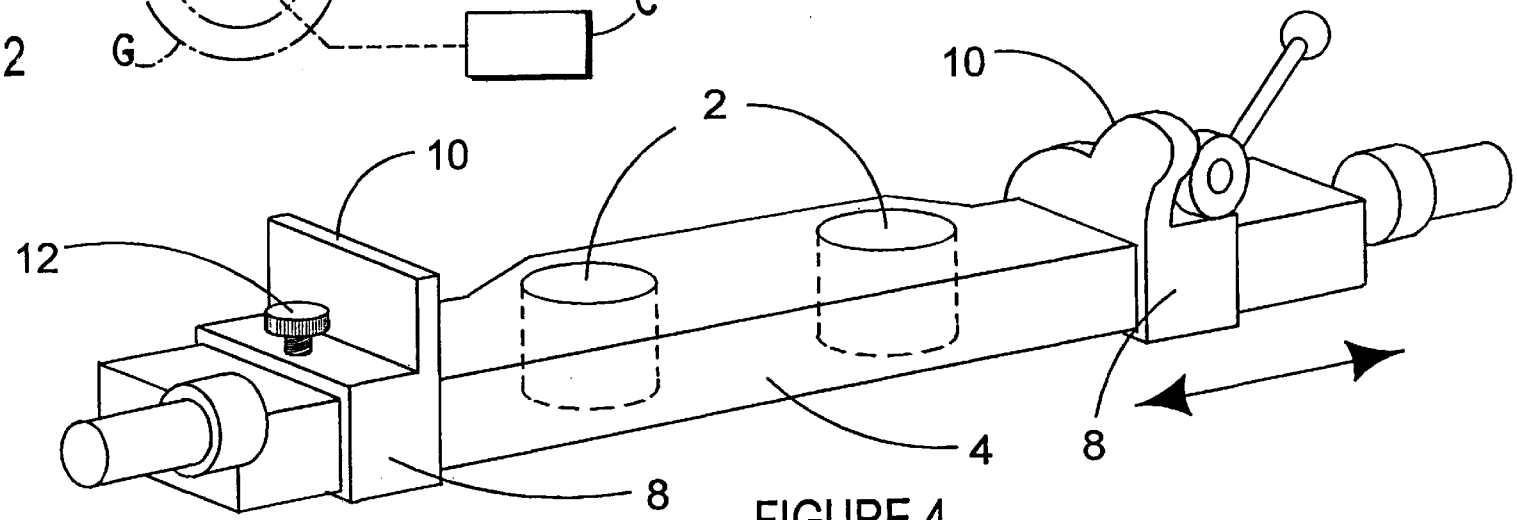
FIG. 4 is schematic perspective view of the device not including the grinder.
Figure 5:
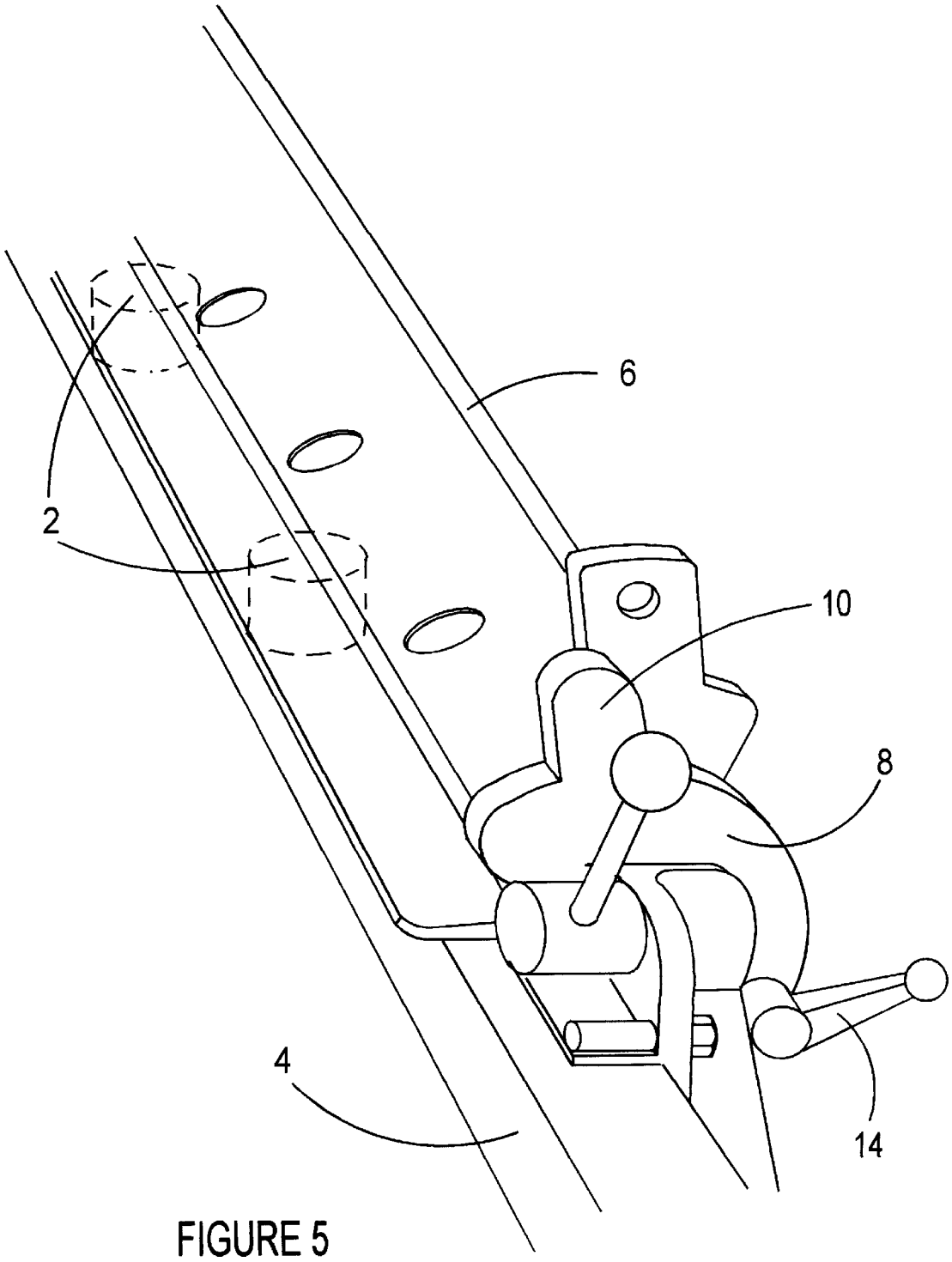
FIG. 5 is a perspective view of the device at one end of the arrangement.

A bedknife 6 is placed upon the mounting bar 4 and electromagnets 2 are energized by suitable energizing means. In this embodiment, the energising means is provided by a manual switch, but it is envisaged that a sensor triggering an automatic switch could be used without departing from the scope of the invention. The bedknife is held in place by the magnets whilst suitable securing means are positioned relative to the bedknife 6 and the bedknife 6 secured to the means. Preferably, the securing means is provided by end brackets 8. It will be seen from FIG. 4, the securing means are slidable along the mounting bar 4 to accommodate bedknives 6 of different lengths. Each bracket 8 has an upstand 10 to engage with the longitudinal ends of the bedknife and suitable means to prevent unwanted sliding movement such as locking screw 12 or lever 14.

Alternatively, securing means could be provided in the form of clamps which engage on the upper face of the bedknife 6. It is envisaged that other known forms of securing means to be used.

The grinding of the bedknife is carried out by a grinder driven by suitable drive means, for example electric, pneumatic or hydraulic motors (not shown). As soon as the drive means is started, a signal is transmitted to suitable control means such as a solenoid, relay or logic circuit, which in turn de-energizes the electromagnets 2 so that they might not artificially distort the bedknife 6 during the grinding operation. End brackets 8 prevent movement of the bedknife 6 relative to the mounting bar 4 during grinding.

Once the grinding operation is complete, the grindstone motor is stopped, a further signal is transmitted to the control means which re-energizes the electromagnets 2 to hold the bedknife 6 in place whilst the securing means is 8 are detached.

The electromagnets 2 are then de-energized by the manual switch so that the bedknife 6 can be removed from the device.

It will be understood that the grinding device of the invention has been illustrated with reference to a specific embodiment and that numerous modifications are possible within the scope of the invention. The grinding device of the invention is beneficial for sharpening any machine containing a linear blade.

I claim:

1. A device for grinding a bedknife of a lawnmower, the bedknife comprising axial ends, which device comprises support means to support the bedknife during grinding, at least one electromagnet energized to hold the bedknife in a pre-selected position relative to the support means, grinding means to grind the bedknife, and control means to automatically de-energize said at least one electromagnet upon commencement of grinding.

2. A device according to claim 1 wherein the at least one electromagnet is energized by means of a manual switch.

3. A device according to claim 1 further comprising securing means comprising end mounted brackets which secure the bedknife relative to the support means.

4. A device according to claim 3 wherein said support means comprises a mounting bar providing support along the entire length of the bedknife.

5. A device according to claim 4 wherein said at least one electromagnet is mounted flush with the top face of the mounting bar.

6. A device according to claim 4 wherein one of the end mounted brackets is positioned adjacent each axial end of the bedknife.

7. A device according to claim 6 wherein at least one of said brackets is slidably fixable to secure the bedknife to the mounting bar.

8. A securing assembly for a bedknife grinding device comprising support means to support the bedknife during grinding, at least one electromagnet energized to hold the bedknife in a pre-selected position relative to the support means, and control means to automatically de-energize said at least one electromagnet upon commencement of grinding.

9. A securing assembly according to claim 8 wherein said at least one electromagnet is energized by means of a manual switch.

10. A securing assembly according to claim 8 further comprising securing means comprising end mounting brackets which secure the bedknife relative to the support means.

11. A securing assembly according to claim 10 wherein said support means comprises a mounting bar providing support along the entire length of the bedknife.

12. A securing assembly according to claim 11 wherein said at least one electromagnet is mounted flush with the top face of the mounting bar.

13. A securing assembly according to claim 11 wherein one of the end mounted brackets is positioned adjacent each axial end of the bedknife.

14. A securing assembly according to claim 13 wherein at least one of said brackets is slidably fixable to secure the bedknife to the mounting bar.

15. A method for grinding the bedknife of a lawnmower, comprising placing the bedknife of the lawnmower on a mounting bar, manually energizing at least one electromagnet, securing the bedknife to at least one mounting bracket, commencing the grinding of the bedknife at which time the at least one electromagnet is automatically de-energized, ceasing grinding the bedknife at which time the electromagnet is automatically energized freeing the bedknife from the at least one mounting bracket, and manually de-energizing said at least one electromagnet to permit the removal of the bedknife.

* * * * *